US006231620B1

(12) United States Patent
Tsui

(10) Patent No.: US 6,231,620 B1
(45) Date of Patent: May 15, 2001

(54) LOW RATIO YARN PACKAGE TREATMENT APPARATUS AND METHOD

(76) Inventor: On Kat Tsui, #1937 22nd Street, West Vancouver, Vancouver, British Columbia (CA), V7V 4E7

( * ) Notice: Subject to any disclaimer, the term of this patent is extended or adjusted under 35 U.S.C. 154(b) by 0 days.

(21) Appl. No.: 09/392,712

(22) Filed: Sep. 9, 1999

(51) Int. Cl.[7] ..... D06B 5/18
(52) U.S. Cl. ..... 8/155.1; 68/27; 68/189
(58) Field of Search ..... 8/155.1; 68/27, 68/189

(56) References Cited

U.S. PATENT DOCUMENTS 1,021,811 4/1912 Windrath et al. .
3,967,923 7/1976 Ameling .
3,969,074 * 7/1976 Chung ..... 68/27 X

OTHER PUBLICATIONS

D.H. Wyles; "Functional design of coloration machines"; Engineering in Textile Coloration; Dyers Company Publications Trust; 1983; pp. 1–13.

* cited by examiner

*Primary Examiner*—Philip R. Coe
(74) *Attorney, Agent, or Firm*—Adams, Schwartz & Evans, P.A.

(57) ABSTRACT

A low ratio yarn treatment apparatus for dyeing yarn packages mounted on perforated spindles. A first vessel is provided for holding a first spindle-mounted array of yarn packages to be treated and a second vessel for holding a second spindle-mounted array of yarn packages to be treated. A first conduit is provided in liquor flow communication with the first vessel and the second vessel for permitting treatment liquor to flow therebetween and a second conduit is provided for being connected in liquid flow communication with perforated spindles positioned in the first vessel and with perforated spindles positioned in the second vessel for permitting treatment liquor to flow between the perforated spindles in the first vessel and the perforated spindles in the second vessel. Pump means is provided and cooperates with the first conduit for inducing flow of the treatment liquor to a desired level within the first vessel and second vessel, and inducing flow of the treatment liquor in alternating directions between the first vessel and the second vessel and cooperating with the second conduit for inducing flow of the treatment liquor in alternating in-to-out and out-to-in directions between perforated spindles positioned in the first vessel and perforated spindles positioned in the second vessel.

7 Claims, 4 Drawing Sheets

LOW RATIO YARN PACKAGE TREATMENT APPARATUS AND METHOD

TECHNICAL FIELD AND BACKGROUND OF THE INVENTION

This invention relates to a low ratio yarn package treatment apparatus and method. Most modem yarn dyeing is carried out after the yarn has been wound onto suitable packages and formed into cheeses, cones or cakes, which are then mounted onto perforated spindles carried on a yarn package carrier. The loaded carrier is then placed into a pressure vessel, and the yarn is dyed by forcing a liquor of water, dye and perhaps various additives through the packages. Early machines were open to the atmosphere and dyeing took place only from the inside to the outside of the package, i.e., the dye liquor was forced from the perforated spindles through the yarn from the inside of the package to the outside. The liquor was then withdrawn from the vessel and recirculated in the same manner.

Later machines were enclosed, and by reversing a liquor pump, liquor could be alternately forced through the yarn from the inside to the outside and then from the outside to the inside. This process remains the most commonly used, because the alternating inside-out, outside-in dyeing results in the most uniform dyeing of the yarn.

In conventional package dyeing machines, the liquor ratio is relatively constant and is based on the weight of the yarn which can be dyed in a given capacity vessel. The "ratio" is based on the weight of yarn that can be dyed using a given weight of liquor. Thus, a ratio of 10:1 refers to a dye process where, for example, 10,000 pounds of liquor is required to dye 1,000 pounds of yarn. This normally occurs when the vessel is fully flooded, completely covering the yarn package carrier and filling even the domed cover of the vessel.

While this practice generally provides the best dyeing results, particularly with deep shades, this large ratio results in a considerable amount of dye being left over in the liquor after dyeing is complete. The dye is typically dumped with the waste water into a nearby river or sewer, or into a wastewater holding area or treatment facility. Increasingly strict government regulation in many areas now limits the extent to which wastewater containing dyes and other yarn treatment additives can be disposed of without expensive treatment processes.

These requirements, as well as demands for energy conservation, reduced dyeing costs and faster dyeing times have led to techniques whereby varying amounts of dye liquor are used in order to reduce the liquor ratio. One such technique involves partially flooding the vessel to above the level of the packages, but leaving the dome of the vessel unfilled, thus reducing the liquor ratio to about 8:1. Another technique involves a low-liquor state in which only the base of the carrier is covered with dye liquor. The liquor is pumped up through the spindles of the carrier and through the packages from the inside-out. Liquor ratios can be reduced to 4:1 or even 3:1 using this technique. However, dyeing can take place only in the in-to-out flow direction. The packages must be sufficiently rigid not to distort under these conditions. Significant economies can be obtained by reducing the liquor ratio in this manner. However, the economies obtained are often outweighed by difficulties with dye solubility, dispersion stability and dyeing unevenness, particularly where deep shades are being imparted to the yarn.

The present invention achieves low ratio dyeing on the order of 4:1 or 3:1 while nevertheless permitting full submersion of the yarn packages and alternating in-to-out and out-to-in dyeing. This is accomplished while otherwise carrying out conventional dyeing processes using conventional dyes and additives, and with equipment which can be modified from conventional dyeing equipment.

While dyeing is described in this application as a preferred embodiment of the practice of the method of the invention, the invention is intended to apply to all types of yarn treatments wherein yarn is wet-processed in a dye vessel. It is believed that the invention may have broad application to the dyeing of fibers in the form of raw stock, various yarn forms and even in apparel form, consistent with the principles set out in this application.

SUMMARY OF THE INVENTION

Therefore, it is an object of the invention to provide a yarn package treatment apparatus and method for treating yarn packages at low liquor ratios.

It is another object of the invention to provide a yarn package treatment apparatus and method for treating yarn packages at low liquor ratios while subjecting the yarn packages to alternating in-to-out and out-to-in liquor flow.

It is another object of the invention to provide a yarn package treatment apparatus and method for treating yarn packages at low liquor ratios using equipment easily modified from existing conventional yarn package dyeing equipment.

It is another object of the invention to provide a yarn package treatment apparatus and method for treating yarn packages at low liquor ratios with conventional dyes and additives.

These and other objects of the present invention are achieved in the preferred embodiments disclosed below by providing a low ratio yarn treatment apparatus for dyeing yarn packages mounted on perforated spindles, comprising a first vessel for holding a first spindle-mounted array of yarn packages to be treated and a second vessel for holding a second spindle-mounted array of yarn packages to be treated. A first conduit is provided in liquor flow communication with the first vessel and the second vessel for permitting treatment liquor to flow therebetween and a second conduit is provided for being connected in liquid flow communication with perforated spindles positioned in the first vessel and with perforated spindles positioned in the second vessel for permitting treatment liquor to flow between the perforated spindles in the first vessel and the perforated spindles in the second vessel. Pump means is provided and cooperates with the first conduit for inducing flow of the treatment liquor to a desired level within the first vessel and second vessel, and inducing flow of the treatment liquor in alternating directions between the first vessel and the second vessel and cooperating with the second conduit for inducing flow of the treatment liquor in alternating in-to-out and out-to-in directions between perforated spindles positioned in the first vessel and perforated spindles positioned in the second vessel.

According to one preferred embodiment of the invention, the pump means comprises a first reversing pump cooperating with the first conduit for inducing flow of the treatment liquor in alternating directions between the first vessel and the second vessel, and a second reversing pump cooperating with the second conduit for inducing flow of the treatment liquor in alternating in-to-out and out-to-in directions between perforated spindles positioned in the first vessel and perforated spindles positioned in the second vessel.

According to another preferred embodiment of the invention, the spindles are positioned on a yarn carrier base, and the yarn carrier base includes a port communicating with the second conduit and the perforated spindles for permitting alternating liquor flow to and from the second conduit and into and out of the spindles.

A method of low liquor ratio treatment of yarn packages mounted on perforated spindles positioned on respective first and second yarn carriers, comprises the steps of providing first and second treatment vessels interconnected by liquor flow conduits wherein flow is induced by pumps, each of the first and second treatment vessels adapted to receive a respective one of the first and second yarn carriers therein for treatment of the yarn. The first treatment vessel is filled with sufficient treatment liquor to cover all of the yarn packages on the yarn carrier therein while leaving the yarn packages in the second treatment vessel substantially uncovered by the liquor. The liquor is pumped for a predetermined period of time from the first treatment vessel through the yarn packages from the outside to the inside and into the perforated spindles, from the yarn carrier in the first vessel into the second vessel, and into the yarn carrier in the second vessel, through the perforated spindles and through the yarn packages from the inside to the outside and into the second vessel. Liquor is simultaneously pumped from the second treatment vessel back into the first treatment vessel to maintain the liquor level above the level of the yarn packages in the first treatment vessel. At the end of the predetermined period of time, the liquor covering the yarn packages in the first treatment vessel is pumped into the second treatment vessel to cover the yarn packages therein. Process steps are carried out in reverse flow direction for a predetermined period of time whereby the yarn in the second treatment vessel is treated by outside-to-inside liquor flow and the yarn in the first treatment vessel is treated by inside-to-outside liquor flow. The alternating process steps are carried out to completion of the yarn treatment.

According to one preferred embodiment of the invention, the yarn treatment comprises dyeing.

Preferably, the step of pumping liquor from the first treatment vessel to the second treatment vessel is performed by a first pump and the step of simultaneously pumping the liquor from the second treatment vessel is performed by a second pump.

According to another preferred embodiment of the invention, the step of pumping the liquor between the second treatment vessel and the first treatment vessel during alternating process step is performed by the pumps operating in reverse directions.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
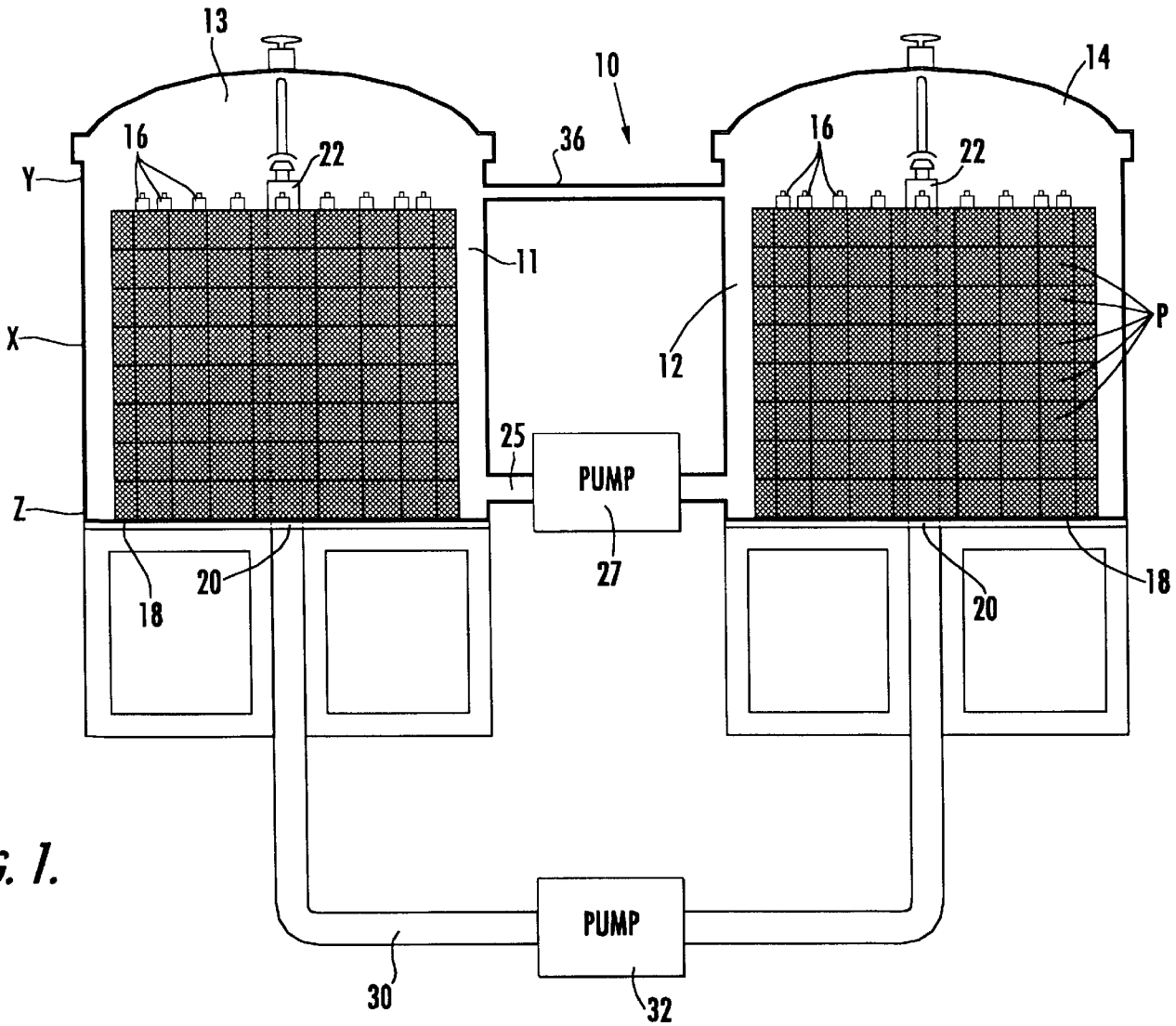
FIG. 1 is a simplified side elevation of an apparatus according to a preferred embodiment of the invention.

Referring now specifically to the drawings, a low liquor ratio yarn treatment apparatus according to the present invention is illustrated in FIG. 1 and shown generally at reference numeral 10. The drawings have been greatly simplified in order to highlight the novel aspects of the invention. Thus, many details of the apparatus, including covers, heaters, auxiliary pumps, addition tanks, valving, piping and other features typical to package dyeing in pressure vessels are omitted as not being essential to the understanding or description of the invention. As noted above, the apparatus 10 and the related method are described in relation to dyeing yarn on packages.

The yarn treatment apparatus 10 includes two pressure vessels 11 and 12 including domed covers 13 and 14, respectively, which are closed during yarn dyeing and are provided with safety interlocks to prevent opening while there is internal residual pressure within the vessel or when the temperature exceeds a predetermined amount.

Yarn packages "P" are mounted on vertical hollow spindles 16, which are perforated to permit the flow of dye liquor. The spindles 16 are typically circular in cross-section, although some are "Y" in cross-section to permit more efficient longitudinal flow the dye liquor. The spindles 16 are screwed firmed into threaded holes set in a yarn carrier base 18. The base 18 has an inlet/outlet 20 which communicates with the spindles 16 to permit dye liquor flow. A central pillar 22 is used for attachment to an overhead hoist by which the loaded carrier base 18 is lowered into and lifted out of the vessels 11 and 12.

At the top of each spindle 16 a screw thread (not shown) is provided to enable an end plate and end cap to be fitted. These elements keep the yarn packages close together and prevent the dye liquor from flowing from the spindles 16 and out through spaces between the yarn packages instead of through the yarn.

Still referring to FIG. 1, the two vessels 11 and 12 are connected by a first conduit 25 which extends between the two vessels 11 and 12, as shown. A reversing pump 27 induces the flow of dye liquor between the vessels 11 and 12 according to the operation of the apparatus 10, as described below.

The two vessels 11 and 12 are also connected by a second conduit 30 which extends between the two vessels 11 and 12, as shown. A reversing pump 32 induces the flow of dye liquor between the vessels 11 and 12 according to the operation of the apparatus 10, as described below. As shown in FIG. 1, conduit 30 interconnects with the inlet/outlets 20 of the yarn carrier bases 18 in both of the vessels 11 and 12.

An overflow pipe 36 connects both vessels 11 and 12 near their respective covers 13, 14 and allows dye liquor to flow between the vessels 11 and 12 as needed in event of an overflow condition.

Selection of the pumps 27 and 32, and sizing of the conduits 25 and 30 is made in accordance with known criteria. Generally, the pumps must be selected to produce sufficient pressure to overcome the resistance to liquid flow and maintain the necessary flow volume. The pumps may be axial or centrifugal pumps with reversing mechanisms and valving in accordance with conventional practice. Pump 32 is a more powerful pump than pump 27, since it must force the dye liquor into the carrier base 18 and through the inlet/outlet 20 and up through the spindles 16, and through the yarn packages "Y". Pump 27 is used to maintain the proper liquor level in the vessels 11 and 12.

Conduits 25 and 30 should be as short in length as possible and as large in diameter as possible in order to reduce frictional losses. A reduction in conduit diameter by half increases the liquor velocity by the power of two and the frictional losses by the power of five.

Figure 2:
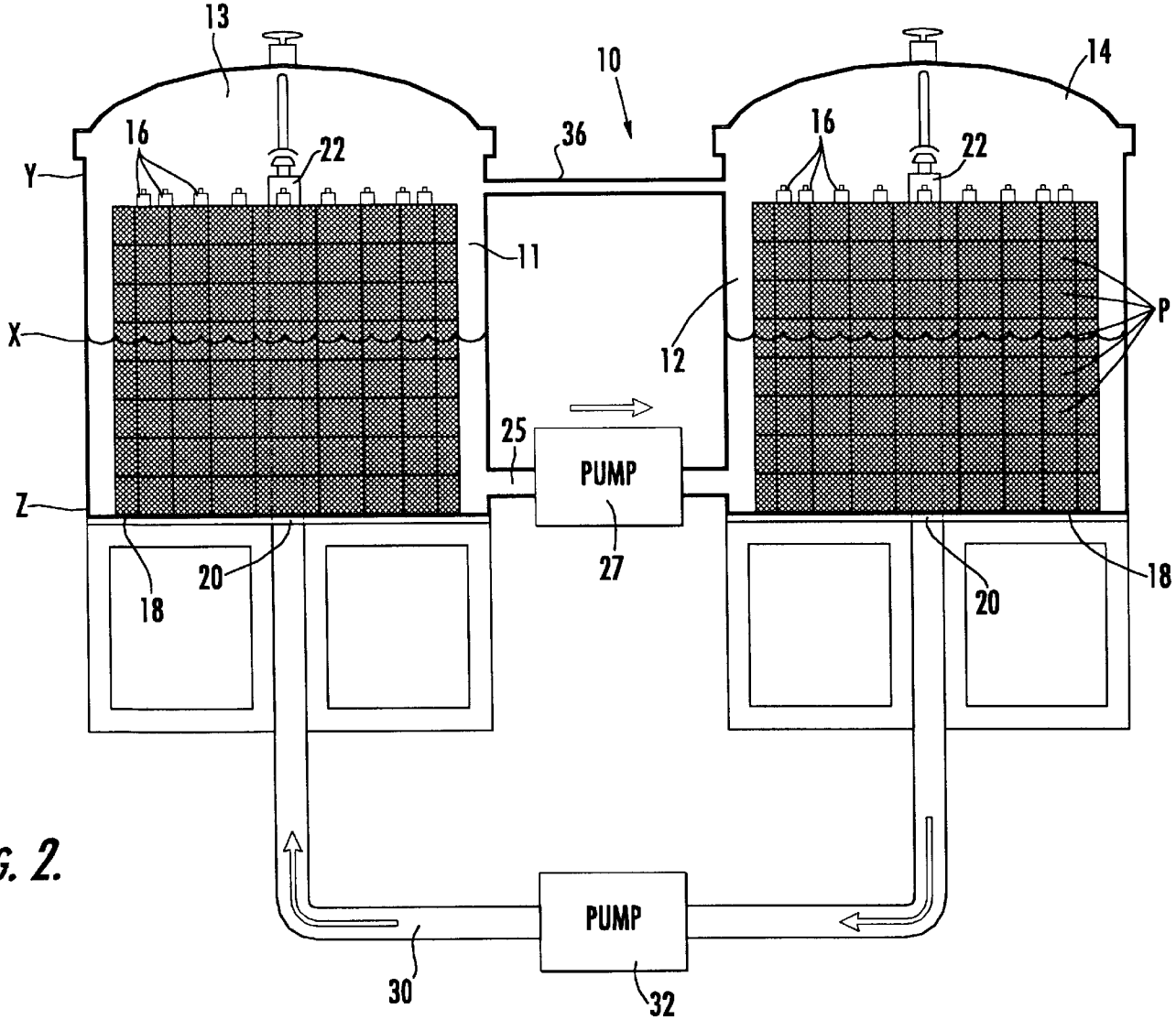
FIGS. 2, 3 and 4 are views according to FIG. 1, further simplified, and illustrating the operation of the apparatus according to the method according to a preferred embodiment of the invention.
Figure 3:
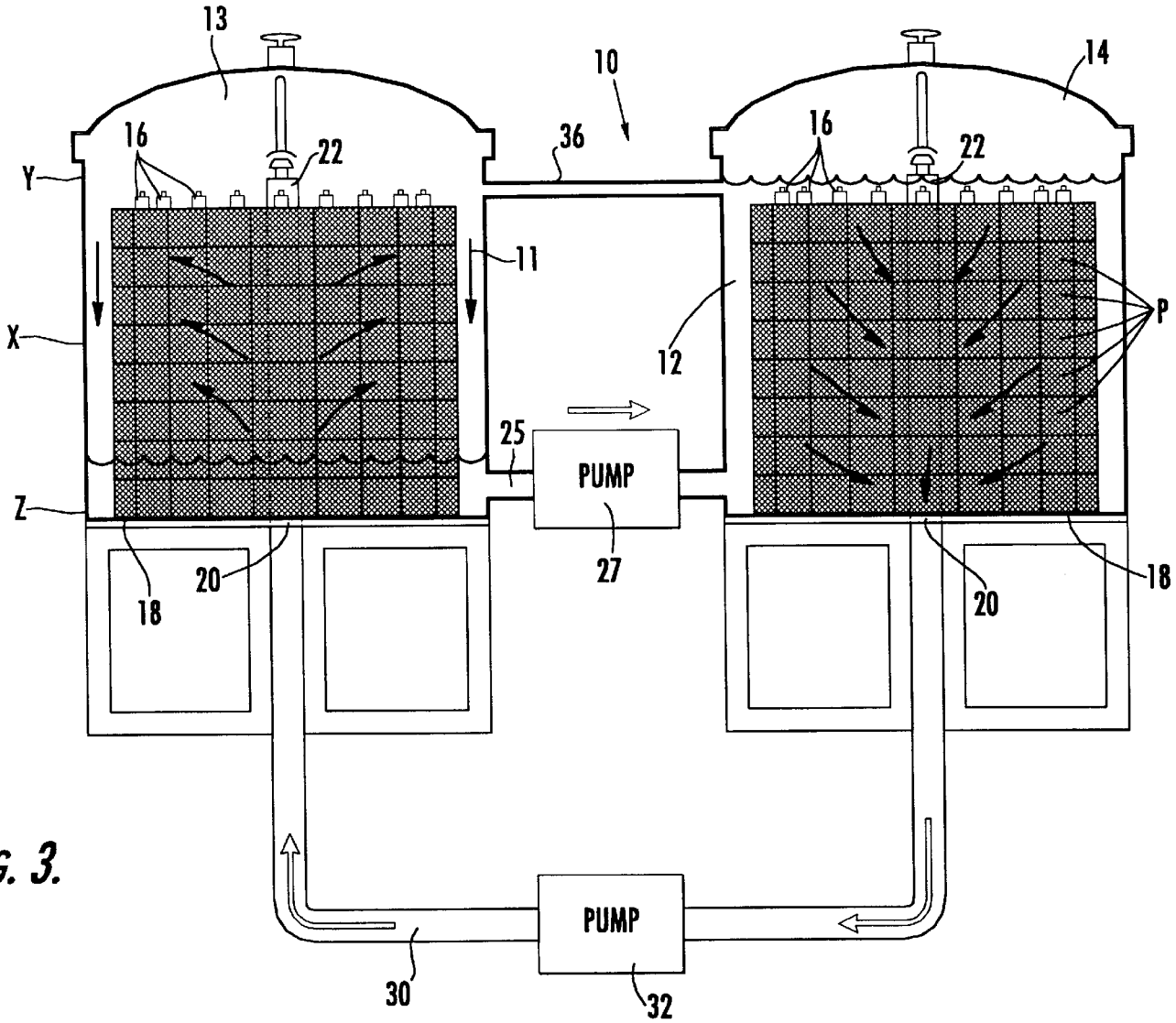
Figure 4:
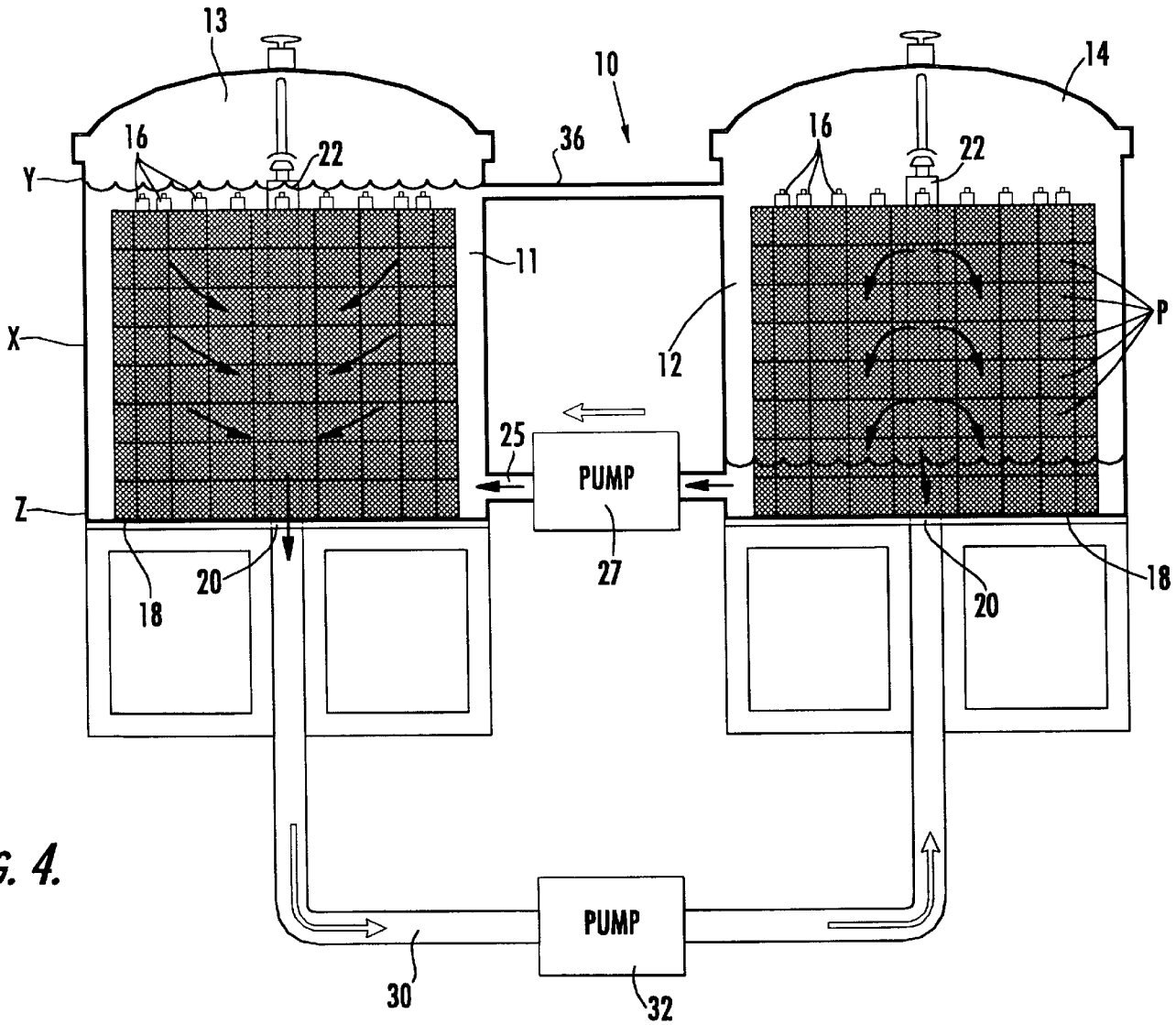

Referring now to FIGS. 2, 3 and 4, the operation of the apparatus 10 according to an embodiment of the method is described.

As is shown in FIG. 2, the two vessels 11 and 12 are each filled to a predetermined level, designated as "X", which may be where both vessels 11 and 12 are approximately one-half full. By way of example, assume that each vessel 11 and 12 will accommodate 8,000 pounds of water and 1000 pounds of yarn. Under conventional yarn package dyeing practice a liquor ratio of 8:1 would be necessary in order to dye the yarn by completely filling the vessel. In accordance with the invention, 8,000 pounds of liquor is prepared, but is initially divided between the two vessels 11 and 12, each of which contain 1,000 pounds of yarn, as shown in FIG. 2.

At the start of the dyeing cycle, pump 27 pumps the liquor in vessel 11 into vessel 12, lowering the liquor level in vessel 11 to level "Z", and raising the level of liquor in vessel 12 to "Y." See FIG. 3. At this point, pump 32 is activated, pumping liquor from vessel 12 back into vessel 11. Conduit 30 communicates with the spindles 16 in both vessels 11 and 12, so as shown in FIG. 3, dye liquor in vessel 12 is pulled through the yarn packages "P" from the outside to the inside, into the perforated spindles 16 and down into the carrier base 18, through the inlet/outlet 20 and through conduit 30, into the carrier base 18 in vessel 11, up through the spindles 16 and forced through the yarn packages "P" in vessel 11 from the inside to the outside.

The liquor in vessel 11 flows down into the bottom of the vessel 11, where it is captured and pumped by pump 27 back into vessel 12, maintaining the dye liquor level in vessel at level "Y." The dye liquor may also be heated during this phase of the process in a conventional manner by horizontal heat exchanging coils located in the lower part of the vessel 11 just below the level of the carrier base 18.

In summary, the circular movement just described results in simultaneous out-to-in dyeing in vessel 12 and in-to-out dyeing in vessel 11. The yarn packages in vessel 12 are fully submerged in dye liquor and are dyed at an effective liquor ratio of 8:1, while very efficient, low ratio dyeing of the yarn packages in vessel 11 also takes place.

Dyeing in the direction described above will take place for a predetermined period of time, for example, three minutes. A timer (not shown) then activates appropriate circuitry to reverse the direction of the process described above.

As is shown in FIG. 4, pump 27 reverses direction and pumps most of the dye liquor in vessel 12 into the vessel 11, filling vessel 11 to level "Y" and reducing the level of the dye liquor in vessel 12 to level "Z." At this point, pump 32 is activated, pumping liquor from vessel 11 back into vessel 12. As shown in FIG. 4, dye liquor in vessel 11 is pulled through the yarn packages "P" from the outside to the inside, into the perforated spindles 16 and down into the carrier base 18, through the inlet/outlet 20 and through conduit 30, into the carrier base 18 in vessel 12, up through the spindles 16 and forced through the yarn packages "P" in vessel 12 from the inside to the outside.

The liquor in vessel 12 flows down into the bottom of the vessel 12, where it is captured and pumped by pump 27 back into vessel 11, maintaining the dye liquor level in vessel 11 at level "Y." The dye liquor may also be heated during this phase of the process in a conventional manner by horizontal heat exchanging coils located in the lower part of the vessel 12 just below the level of the carrier base 18.

In summary, the circular movement just described results in simultaneous out-to-in dyeing in vessel 11 and in-to-out dyeing in vessel 12. The yarn packages in vessel 11 are filly submerged in dye liquor and are dyed at an effective liquor ratio of 8:1, while very efficient, low ratio dyeing of the yarn packages in vessel 12 also takes place.

After a predetermined period of time the process is reversed in direction again. This happens repeatedly until the dyeing or other yarn treatment process is completed.

The result is an effective dye liquor ratio of 4:1, while nevertheless subjecting the yarn in both vessels 11 and 12 to fully, submerged out-to-in dyeing at an 8:1 ratio as well as alternating in-to-out dyeing. Dyeing efficiency is greatly improved by reducing the amount of dye needed, reducing the amount of water needed by half without compromising the advantages of dyeing at a relatively high liquor ratio.

A low ratio yarn package treatment apparatus and process is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A low ratio yarn treatment apparatus for dyeing yarn packages mounted on perforated spindles, comprising:

(a) a first vessel for holding a first spindle-mounted array of yarn packages to be treated;

(b) a second vessel for holding a second spindle-mounted array of yarn packages to be treated;

(c) a first conduit in liquor flow communication with the first vessel and the second vessel for permitting treatment liquor to flow therebetween;

(d) a second conduit for being connected in liquid flow communication with perforated spindles positioned in the first vessel and with perforated spindles positioned in the second vessel for permitting treatment liquor to flow between the perforated spindles in the first vessel and the perforated spindles in the second vessel; and (e) pump means cooperating with said first conduit for:

(i) inducing flow of the treatment liquor to a desired level within the first vessel and second vessel; and (ii) inducing flow ofthe treatment liquor in alternating directions between the first vessel and the second vessel and cooperating with said second conduit for inducing flow of the treatment liquor in alternating in-to-out and out-to-in directions between perforated spindles positioned in the first vessel and perforated spindles positioned in the second vessel.

2. A low ratio yarn treatment apparatus according to claim 1, wherein said pump means comprises:

(a) a first reversing pump cooperating with said first conduit for inducing flow of the treatment liquor in alternating directions between the first vessel and the second vessel; and (b) a second reversing pump cooperating with said second conduit for inducing flow of the treatment liquor in alternating in-to-out and out-to-in directions between perforated spindles positioned in the first vessel and perforated spindles positioned in the second vessel.

3. A low ratio yarn treatment apparatus according to claim 1 or 2, wherein the spindles are positioned on a yarn carrier base, and further wherein said yarn carrier base includes a port communicating with the second conduit and the perforated spindles for permitting alternating liquor flow to and from the second conduit and into and out of the spindles.

4. A method of low liquor ratio treatment of yarn packages mounted on perforated spindles positioned on respective first and second yarn carriers, comprising the steps of:

(a) providing first and second treatment vessels interconnected by liquor flow conduits wherein flow is induced by pumps, each of the first and second treatment vessels adapted to receive a respective one of the first and second yarn carriers therein for treatment of the yarn;

(b) filling the first treatment vessel with sufficient treatment liquor to cover all of the yarn packages on the yarn carrier therein while leaving the yarn packages in the second treatment vessel substantially uncovered by the liquor;

(c) pumping for a predetermined period of time the liquor:

(i) from the first treatment vessel through the yarn packages from the outside to the inside and into the perforated spindles;

(ii) from the yarn carrier in the first vessel into the second vessel;

(iii) into the yarn carrier in the second vessel, through the perforated spindles and through the yarn packages from the inside to the outside and into the second vessel;

(d) pumping liquor from the second treatment vessel back into the first treatment vessel to maintain the liquor level above the level of the yarn packages in the first treatment vessel simultaneously with the process step of subparagraph (c); and (e) at the end of the predetermined period of time, pumping the liquor covering the yarn packages in the first treatment vessel into the second treatment vessel to cover the yarn packages therein;

(f) carrying out the process steps of subparagraphs (c) and (d) in reverse flow direction for a predetermined period of time whereby the yarn in the second treatment vessel is treated by outside-to-inside liquor flow and the yarn in the first treatment vessel is treated by inside-to-outside liquor flow; and (g) repeating the process steps of subparagraphs (b), (c) and (d) alternately with the process steps of subparagraphs (e) and (f) to completion of the yarn treatment.

5. A method according to claim 4, wherein the yarn treatment comprises dyeing.

6. A method according to claim 4, wherein the step of pumping liquor from the first treatment vessel to the second treatment vessel during process step (c) is performed by a first pump and the step of simultaneously pumping the liquor from the second treatment vessel is performed by a second pump.

7. A method according to claim 6, wherein the step of pumping the liquor from the second treatment vessel to the first treatment vessel during process steps (e) and (f) is performed by the first pump operating in a reverse direction.

* * * * *